United States Patent [19]

Beresford-Jones

[11] 4,298,778

[45] Nov. 3, 1981

[54] WATERPROOF SEAL FOR A PUSH-BUTTON

[76] Inventor: Godric P. K. Beresford-Jones, Sandbanks, Seal, Near Sevenoaks, Kent, England

[21] Appl. No.: 114,661

[22] Filed: Jan. 23, 1980

[30] Foreign Application Priority Data

Jan. 25, 1979 [GB] United Kingdom ..... 02745/79

[51] Int. Cl.[3] ..... H01H 9/04

[52] U.S. Cl. ..... 200/302; 200/308; 200/333

[58] Field of Search ..... 200/302, 333, 340, 308, 200/330, 159 R

[56] References Cited

U.S. PATENT DOCUMENTS

| | | | |
|---|---|---|---|
| 2,790,881 | 4/1957 | Schueler | 200/302 |
| 3,316,379 | 4/1967 | Clarke et al. | 200/333 |
| 3,790,734 | 2/1974 | Raab et al. | 200/308 |

*Primary Examiner*—Willis Little

*Attorney, Agent, or Firm*—McAulay, Fields, Fisher, Goldstein & Nissen

[57] ABSTRACT

The invention relates to a waterproof seal for a push button 10 in a panel 11. The seal comprises a shroud of resilient material having a substantially cylindrical portion 1 and closed at one end 2. The closed end is collapsible inwardly and the open end is sealable to the panel 11. The invention is useful for protecting push buttons in control panels in watercraft and other vehicles exposed to wet conditions.

5 Claims, 1 Drawing Figure

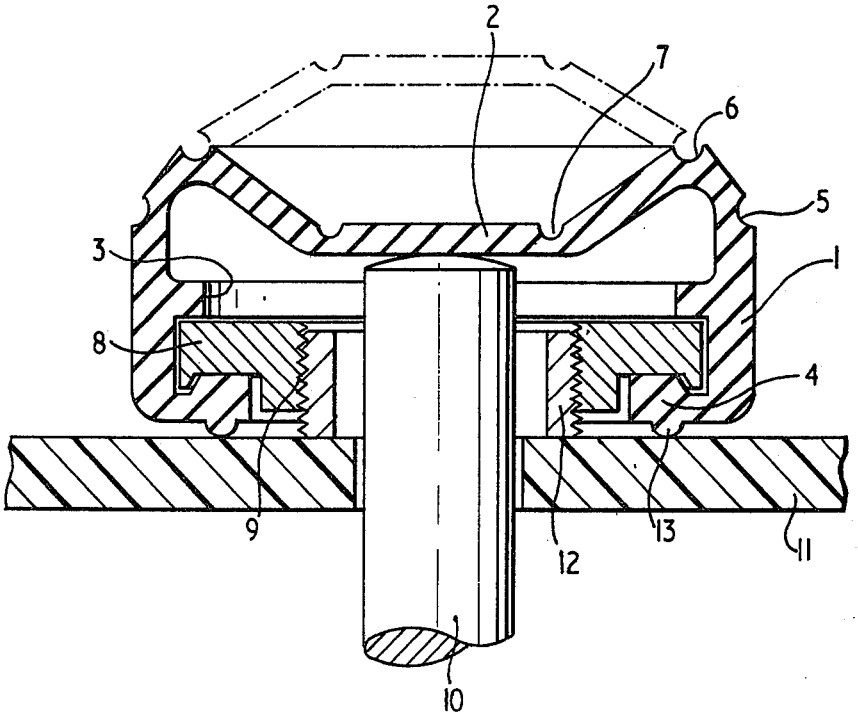
2
7
6
5
3
1
8
4
9
12
13
11
10

WATERPROOF SEAL FOR A PUSH-BUTTON

This invention relates to a waterproof seal for a push button and to a sealed push button assembly.

Control panels frequently have push buttons to operate switches. A spring-loaded button is pressed to give the "on " position. The button is caused to return to the "off" position either by pressing a second "release" button on the panel or by a second press on the same button. The button itself gives both a visual and a tactile indication of whether it is in the "on" or "off" position. There is inevitably a small gap between the button and the surrounding panel. The use of such push buttons in control panels in watercraft and other vehicles exposed to wet conditions has hitherto been somewhat restricted, because water has been found to leak into electrical components behind the control panel through the gap around the button.

There is therefore a requirement for push buttons in a control panel to be sealed in a watertight fashion. In principle this can be done by providing a cover for the button and sealing the cover, for example by glue, to the panel around the button. The cover must be sufficiently flexible to allow the button to be pressed in and released relative to the panel, and rubber would be a suitable material for such a cover. However, this arrangement suffers from two disadvantages. The cover is not readily detachable from the panel, and this makes servicing of the button difficult. As the button is covered, there is no visual or tactile indication of whether the button is in the "on" or "off" position.

An object of this invention is to provide a waterproof seal for a push button which does not suffer from the disadvantages outlined above.

The invention provides a waterproof seal for a push button in a panel, comprising a shroud of resilient material having a substantially cylindrical portion and closed at one end, the closed end being collapsible inwardly and the open end being sealable to the panel.

The invention also provides a sealed push button assembly, comprising a push button mounted in a panel, an upstanding cylindrical member mounted on the panel and surrounding the push button, and a waterproof seal as defined above surrounding the upstanding cylindrical member and shrouding the push button, the waterproof seal cooperating with the upstanding cylindrical member to effect sealing by compression of the open end of the waterproof seal against the panel.

In a preferred embodiment, the substantially cylindrical portion coaxially and sealingly adjoins a screw-threaded, substantially cylindrical metal member adapted to cooperate with a screw-threaded member surrounding the button. The metal member is preferably an insert accomodated within the cylindrical portion, such that, when the combination of seal and metal insert is screwed onto the member surrounding the button, part of the seal is compressed between the metal insert and the panel, thus providing effective sealing.

In another embodiment, the cylindrical portion extends around the button to the back of the panel, and sealing is effected by pressing a lip at the open end against the back of the panel.

The closed end is preferably resiliently biased towards the collapsed position.

Reference is now made to the accompanying drawing, which shows an axial slice of a preferred embodiment of push button seal according to the invention, together with the push button and associated components shown partly in section.

The seal shown in the drawing comprises a shroud of resilient silicone rubber. Silicone rubber is a particularly suitable material because it has a good "memory". A substantially cylindrical portion 1 has a closed end wall 2, an internal circumferential flange 3 and an inwardly directed circumferential end flange 4.

The closed end wall 2 is collapsible inwardly and is resiliently biased towards the collapsed position (shown by solid lines) in which it is cone-shaped. When pressure is applied to the inside surface of the wall 2 it is gradually transformed into a flat disc, and eventually it will "flip" over to the non-collapsed position (shown by broken lines) in which the original cone has become inverted. When the pressure is released, the wall collapses to its original position which is determined by circular grooves 5, 6, 7 on the outside surface and by the "memory" of the silicone rubber. The resilient bias towards the collapsed position is achieved by virtue of the stresses which are set up in the silicone rubber as it is transformed from the cone shape to the flat disc and beyond. These stresses are released when the rubber springs back to the cone shape.

The internal wall of the cylindrical portion 1 between the flanges 3 and 4 accommodates a cylindrical metal insert 8. The insert terminates within the open end of the seal and is internally screw-threaded on its cylindrical surface 9. The push button 10 to be sealed projects through a panel 11.

Immediately surrounding the button there is mounted on the panel a circular upstanding flange 12 which is screw-threaded on the outside so as to cooperate with the internal screw threads of the insert 8. As the combined insert and seal are screwed onto the upstanding flange, the end flange 4 of the seal is compressed between the insert and the panel and makes a waterproof seal. A ring 13 of semi-circular section is provided on the bottom surface of the flange 4 to improve this seal.

When the closed end wall 2 of the seal is pressed, the button is pushed to its "on" position. The closed end wall remains in its collapsed position and gives a visual and tactile indication that the button is "on". When the end wall is pressed again, or when a second "release" button is pressed, the button returns to the "off" position and the end wall is then held in the non-collapsed state by the button. Again, this gives a visual and tactile indication that the button is "off". Simply unscrewing the combined seal and insert will afford access to the button for servicing.

I claim:

1. A waterproof seal for a push-button in a panel; comprising a shroud of flexible and resilient material having a substantially cylindrical portion and an end wall closing one end to shroud the push-button; said end wall being normally resiliently biased from a first to a second position in which said end wall is inwardly collapsed to provide a visual and tactile indication of the position of the push-button; and sealing means for sealing the open end of said shroud to the panel.

2. A waterproof seal as in claim 1, in which said end wall is provided with at least one coaxially positioned circular groove to produce said bias.

3. A waterproof seal in accordance with claim 1, in which said sealing means comprises an internally screw-threaded substantially cylindrical insert sealingly adjoining said substantially cylindrical portion and coaxially aligned therewith; said insert being adapted to cooperate with an externally screw-threaded member surrounding the button.

4. A sealed push-button assembly, comprising a push-button mounted in a panel for movement between extended and retracted positions, an upstanding cylindrical member mounted on the panel and surrounding the push-button, and a waterproof seal surrounding the upstanding cylindrical member and shrouding the push-button, said seal comprising a shroud of flexible and resilient material having a substantially cylindrical portion and an end wall closing one end, said end wall being normally resiliently biased from a first to a second position in which said end wall is inwardly collapsed to provide a visual and tactile indication of the position of the push-button, said waterproof seal having engaging means cooperating with the unstanding cylindrical member to effect sealing by compression of the open end of said seal against the panel.

5. An assembly in accordance with claim 4, in which said engaging means comprises an internally screw-threaded substantially cylindrical insert in said substantial cylindrical portion of said seal sealingly adjoining the same and coaxially aligned therewith, and a screw-threaded outer surface on said upstanding cylindrical member threadedly engagable with said insert to effect compression of the open end of said seal against said panel.

* * * * *